US006158551A

United States Patent [19]

Gray

[11] Patent Number: 6,158,551

[45] Date of Patent: Dec. 12, 2000

[54] EXTENSION LADDER SHELF

[76] Inventor: Earl Gray, Box 581 123 SW., Sundance, Wyo. 82729

[21] Appl. No.: 09/484,214

[22] Filed: Jan. 18, 2000

Related U.S. Application Data

[60] Provisional application No. 60/121,964, Feb. 25, 1999.

[51] Int. Cl.[7] ..... E04G 5/02; E04G 3/00; E06C 7/06

[52] U.S. Cl. ..... 182/107; 182/214; 248/292.12

[58] Field of Search ..... 182/107, 129, 182/214; 248/210, 238, 292.12, 219.2

[56] References Cited

U.S. PATENT DOCUMENTS

| | | | |
|---|---|---|---|
| 1,995,656 | 3/1935 | Stout | 248/292.12 |
| 2,479,008 | 3/1955 | Wilson . | |
| 2,806,642 | 9/1957 | Miele . | |
| 2,911,133 | 11/1959 | Ruggieri | 182/129 |
| 3,042,142 | 7/1962 | Butler . | |
| 3,693,756 | 9/1972 | Walker et al. | 182/129 |
| 3,779,344 | 12/1973 | Rister . | |
| 4,121,692 | 10/1978 | Morawski . | |
| 4,159,045 | 6/1979 | Brooks . | |
| 4,331,217 | 5/1982 | Stecklow . | |
| 4,643,274 | 2/1987 | Tataseo . | |
| 4,771,862 | 9/1988 | Garland | 182/214 X |
| 5,833,028 | 11/1998 | Ramsey et al. | 182/129 |

FOREIGN PATENT DOCUMENTS

| | | |
|---|---|---|
| 2021341 | 7/1979 | United Kingdom . |
| 1578344 | 11/1980 | United Kingdom . |

*Primary Examiner*—Daniel P. Stodola
*Assistant Examiner*—Hugh B. Thompson
*Attorney, Agent, or Firm*—Richard C. Litman

[57] ABSTRACT

An attachment for use on the upper end of standard sized extension ladders. The attachment includes an angularly adjustable tray for supporting tools and other equipment when the ladder is positioned against a wall of a building. The tray is secured to a pair of box-shaped structures which are telescopically positioned over the upper rail ends of the ladder. Cushioning devices are provided on the front end of the tray for engagement with the wall of the building.

6 Claims, 2 Drawing Sheets

EXTENSION LADDER SHELF

CROSS-REFERENCE TO RELATED APPLICATION

This application claims the benefit of U.S. Provisional Patent Application Ser. No. 60/121,964, filed Feb. 25, 1999.

BACKGROUND OF THE INVENTION

1. Field of the Invention

The present invention generally relates to ladder attachments. More specifically, the present invention is drawn to a shelf which is attached to the end of an extension ladder.

2. Description of Related Art

There are many devices known in the art which incorporate some form of attachment for the upper end of a ladder. The prior art devices usually position the ladder away from a vertical wall to enhance stability. The devices also provide a support surface for tools, paint cans, etc. The aforesaid devices are effective in that they permit a user to have both hands free as opposed to having to use one hand to hold a paint can or tool. Time is saved in that trips up and down the ladder are kept to a minimum.

Examples of such prior art devices are shown in U.S. Pat. No. 2,749,008 (Wilson), U.S. Pat. No. 2,806,642 (Miele), U.S. Pat. No. 3,042,142 (Butler), U.S. Pat. No. 3,779,344 (Rister), U.S. Pat. No. 4,121,692 (Morawski), U.S. Pat. No. 4,159,045 (Brooks), U.S. Pat. No. 4,331,217 (Stecklow), U.S. Pat. No. 4,643,274 (Tataseo), British Patents 1,578,344 and 2,012,341.

However, none of the above inventions and patents, taken either singly or in combination, is seen to disclose a lightweight, adjustable, easy to mount, time saving, and durable shelf device as will be subsequently described and claimed in the instant invention.

SUMMARY OF THE INVENTION

The ladder attachment of the present invention comprises an assembly of two box-shaped members which are of a size to fit over the extended top legs of standard sized extension ladders. A shelf or platform bridges the box-shaped members and is attached thereto. The width of the shelf is approximately the same as the width of the ladder. The assembly is fabricated from aluminum so to present a strong, light-weight and durable structure. Fastening devices are provided for angularly adjusting and locking the shelf relative to the ladder. In use, the shelf is adapted to space the ladder outwardly from the face of a vertical support surface (wall), allowing a user to have a reasonable view of his/her work without leaning away from the ladder. The shelf is designed to safely support up to twenty-five pounds of equipment.

It is required that a hole is drilled, adjacent the upper end, in each leg of the ladder so that safety pin bolts may extend through the box-shaped members and the ladder to hold the assembly in place when the ladder is moved. The shelf is adjusted to present a flat horizontal surface for supporting tools and other equipment.

Accordingly, it is a principal object of the invention to provide a tool holding and stabilizing attachment for an extension ladder.

It is another object of the invention to provide a tool holding and stabilizing attachment for an extension ladder, which attachment is angularly adjustable relative to the ladder.

It is a further object of the invention to provide a tool holding and stabilizing attachment for an extension ladder, which attachment may be conveniently detached from the ladder.

Still another object of the invention is to provide a tool holding and stabilizing attachment for an extension ladder, which attachment is strong and durable while being relatively light in weight.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
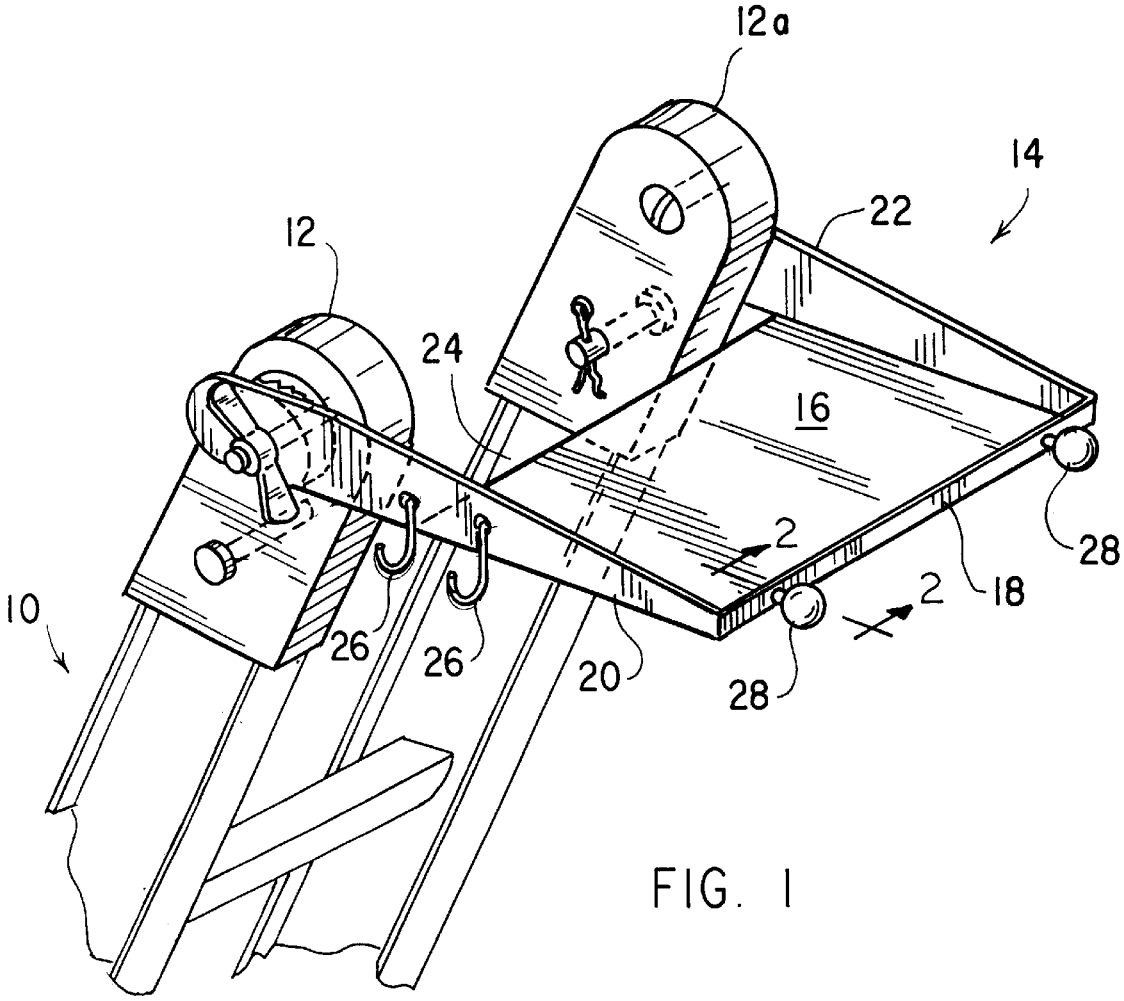
FIG. 1 is an environmental, perspective view of an extension ladder shelf according to the present invention.

Referring to FIG. 1, the top of an extension ladder is shown at 10. Two identically configured box-shaped members 12, 12*a* are telescopically positioned over each leg of ladder 10. A tray or shelf 14 is removably attached to members 12, 12*a*.

Figure 2:
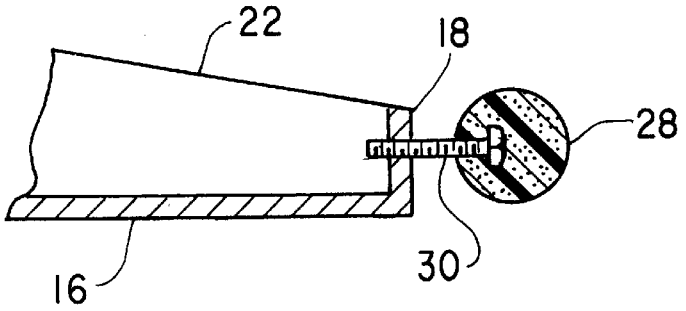
FIG. 2 is a sectional view taken on line 2—2 of FIG. 1 showing details of the cushioning pads according to the present invention.

Shelf 14 comprises a flat planar surface 16 having an upstanding front rim 18. Arms 20 and 22 are attached to the sides of surface 16 and extend beyond rear edge 24. Arm 20 has holes drilled therein for the disposition of removable hooks 26. Hooks 26 may be utilized to hang cleaning rags or other preferred equipment. Although not shown, it is recognized that similar hooks may be provided in arm 22 if desired. It is also recognized that short bolts screwed into the arms may be utilized in lieu of hooks 26. Front rim 18 has cushioning pads 28 attached thereto. As best seen in FIG. 2, cushioning pad 28 is fabricated from hard rubber or the like and is secured on a bolt 30. Bolt 30 is removably attached to front rim 18. Cushioning pads 28 will prevent tray 14 from marring the vertical surface that supports the ladder 10.

Figure 3:
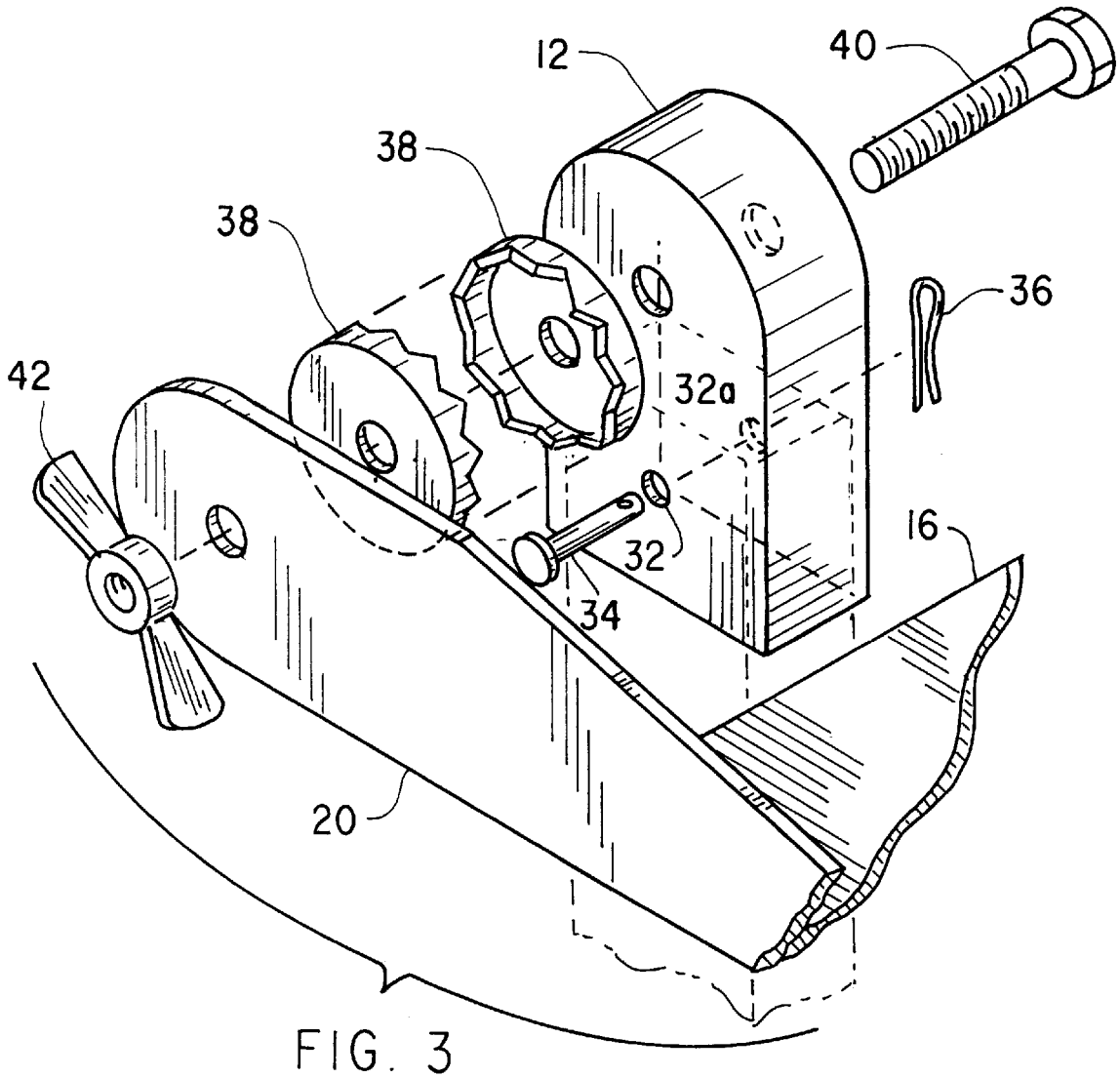
FIG. 3 is an exploded detail view of the fastening and angular adjustment structure for the shelf according to the present invention.

FIG. 3 illustrates the means whereby shelf 14 and members 12, 12*a* are removably secured to the ladder. As mentioned above, openings (not shown) must be drilled adjacent the upper end of each ladder leg. As shown, one leg of the ladder is encapsulated by member 12. Openings 32, 32*a*, formed in member 12, are designed to align with the aforesaid opening (not shown) adjacent the upper end of the ladder. Bolt 34 is inserted through the aligned openings and is secured with pin 36 thereby securing member 12 to the ladder. A pair of opposed-faced, serrated washers 38 are sandwiched by member 12 and arm 20. Washers 38 function as positive locking means for the shelf assembly. Member 12, washers 38, and arm 20 are provided with coaxially aligned apertures for receiving a bolt 40. A wingnut 42 is utilized to secure the assembly. Shelf 14 can be angularly adjusted by simply loosening wingnut 42, adjusting shelf 14 as desired, and re-tightening wingnut 42. Member 12*a* and arm 22 are assembled to the other leg of the ladder in exactly the same fashion.

It is apparent from the above description that the apparatus of the instant invention may be easily attached, detached, and adjusted on standard sized extension ladders. Although indicated of aluminum construction, it is contemplated that the apparatus can be fabricated of any strong, lightweight material (plastic, fiberglass).

It is to be understood that the present invention is not limited to the sole embodiments described above, but encompasses any and all embodiments within the scope of the following claims.

What is claimed is:

1. A support tray adapted to be attached to an upper end of an extension ladder, said ladder having two rails, said tray comprising:

a flat planar portion having a front end, a rear end, a first side and a second side;

an upstanding rim integral with said flat planar portion defining said front end;

a first arm and a second arm, each said first arm and said second arm being integral with said flat planar portion and respectively defining said first side and said second side;

said first arm and said second arm each extending perpendicularly from said front end to positions beyond said rear end;

means for encapsulating each of the ladder's two rails at the upper end thereof, wherein said means for encapsulating includes an identical pair of box-shaped members having open ends, a respective one of said pair of box-shaped members adapted to be telescopically positioned over each of the ladder's rails; and means for adjustably attaching said first arm and said second arm to said means for encapsulating, said means for adjustably attaching including:

a first set of serrated washers disposed between said first arm and one of said pair of box-shaped members; and a second set of serrated washers disposed between said second arm and the other of said pair of box-shaped members.

2. A support tray as defined in claim 1, wherein said means for adjustably attaching includes a first bolt and wingnut assembly for securing said first set of serrated washers between said first arm and said one of said pair of box-shaped members.

3. A support tray as defined in claim 2, wherein said means for adjustably attaching includes a second bolt and wingnut assembly for securing said second set of serrated washers between said second arm and the other of said pair of box-shaped members.

4. A support tray as defined in claim 3, wherein a pair of removable cushioning devices are attached on said upstanding rim and extend perpendicularly therefrom.

5. A support tray as defined in claim 4, wherein said cushioning devices are fabricated from hard rubber.

6. A support tray as defined in claim 5, wherein at least one hook member is removably attached to said first arm.

* * * * *